US009737741B1

(12) United States Patent
Van Lingen

(10) Patent No.: US 9,737,741 B1
(45) Date of Patent: Aug. 22, 2017

(54) FIRE-SUPPRESSION TECHNOLOGY SYSTEM

(71) Applicant: Paul Van Lingen, Sun City, CA (US)

(72) Inventor: Paul Van Lingen, Sun City, CA (US)

( * ) Notice: Subject to any disclaimer, the term of this patent is extended or adjusted under 35 U.S.C. 154(b) by 83 days.

(21) Appl. No.: 14/814,814

(22) Filed: Jul. 31, 2015

Related U.S. Application Data

(60) Provisional application No. 62/036,468, filed on Aug. 12, 2014, provisional application No. 62/032,287, filed on Aug. 1, 2014.

(51) Int. Cl.

| | |
|---|---|
| ***A62C 5/00*** | (2006.01) |
| ***A62C 5/02*** | (2006.01) |
| ***A62C 27/00*** | (2006.01) |
| ***A62C 31/28*** | (2006.01) |

(52) U.S. Cl.
CPC ..... *A62C 5/002* (2013.01); *A62C 5/02* (2013.01); *A62C 27/00* (2013.01); *A62C 31/28* (2013.01)

(58) Field of Classification Search
CPC ..... A62C 5/002; A62C 5/02; A62C 27/00; A62C 31/28
See application file for complete search history.

(56) References Cited

U.S. PATENT DOCUMENTS

| | | | | |
|---|---|---|---|---|
| 4,729,434 | A * | 3/1988 | Rohrbach | A62C 27/00 169/15 |
| 6,029,750 | A * | 2/2000 | Carrier | A62C 27/00 169/13 |
| 2009/0014186 | A1* | 1/2009 | Collins | A62C 27/00 169/24 |
| 2011/0266009 | A1* | 11/2011 | Liu | A62C 27/00 169/52 |
| 2013/0233575 | A1* | 9/2013 | McCoy | A62C 27/00 169/24 |

* cited by examiner

*Primary Examiner* — Ryan Reis

(57) ABSTRACT

A fire-suppression technology system has a tank with outlet and inlet orifices. A reservoir has a dispensing orifice. The tank receives water. The reservoir receives a quantity of powder adapted to be converted to a fire-suppressing fluid when mixed with water. A pump operatively couples the tank and the reservoir. A hose is operatively coupled to the pump. A spool is supports the hose. A primary path of travel constitutes a closed loop path between the tank and the pump and the reservoir to create a fire-suppressing fluid. A secondary path of travel constitutes an open path for dispensing the fire-suppressing fluid from the tank and the pump toward a region to be controlled.

3 Claims, 3 Drawing Sheets

FIG. 2
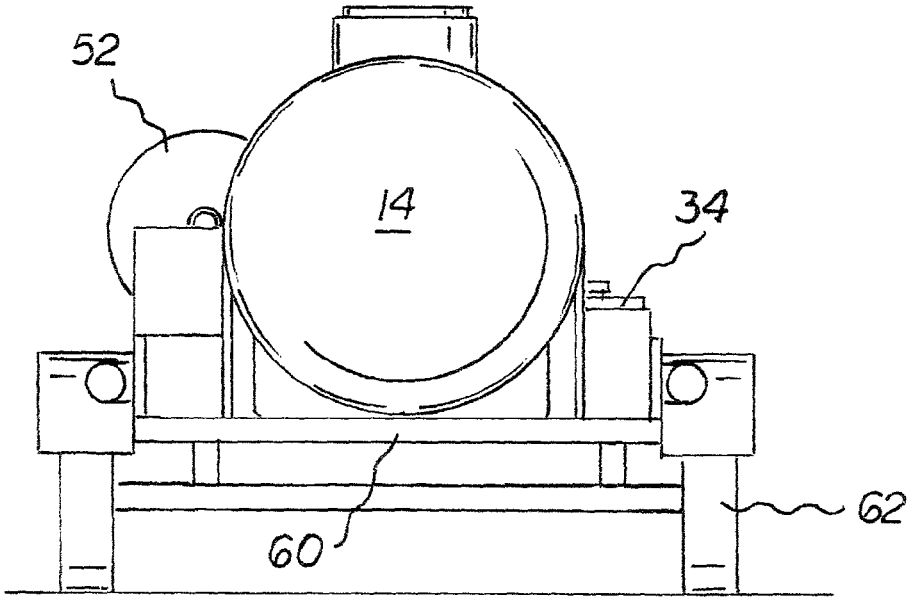
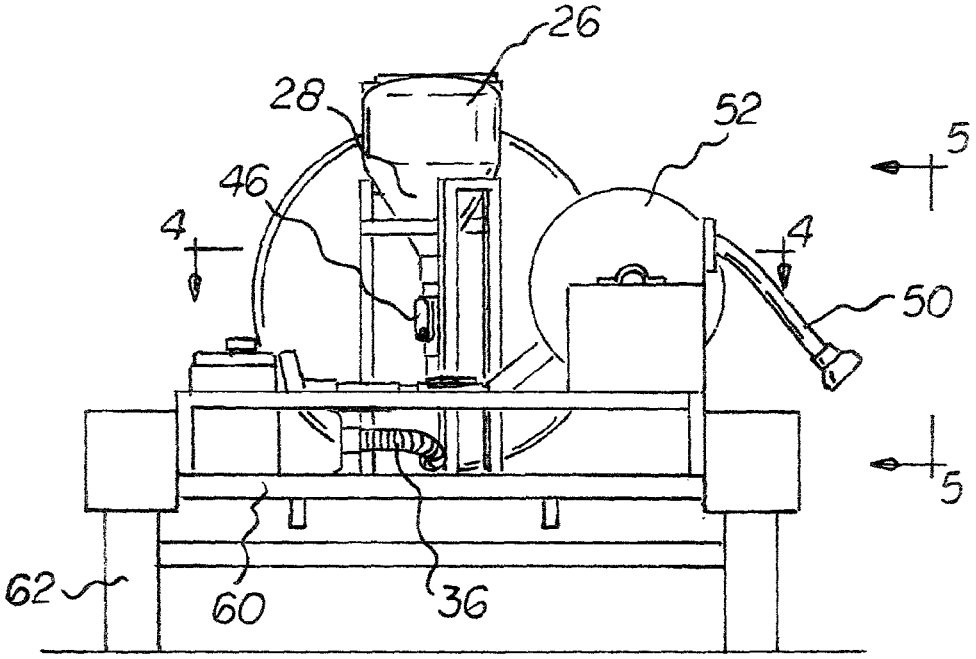
FIG. 3

FIG. 4
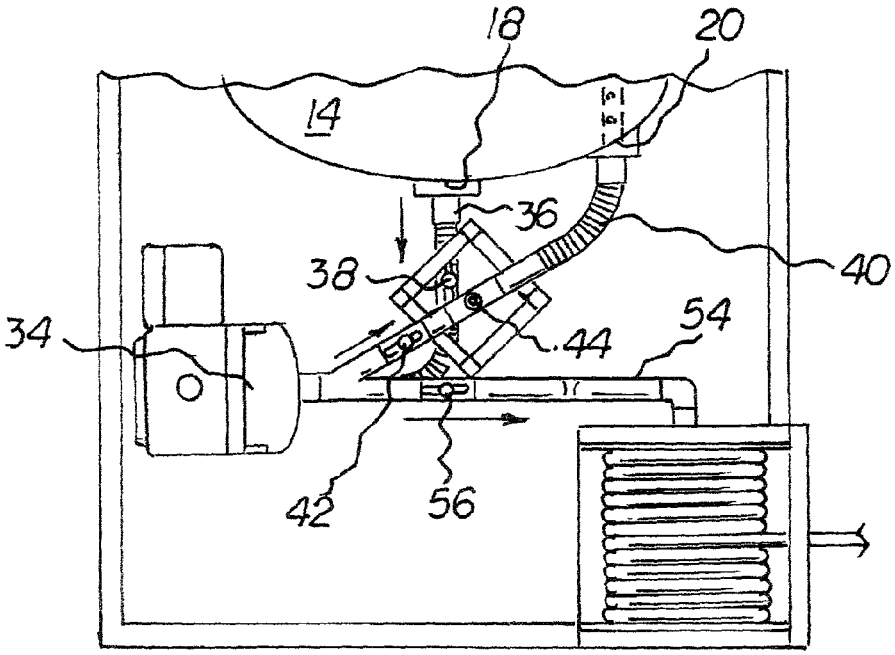
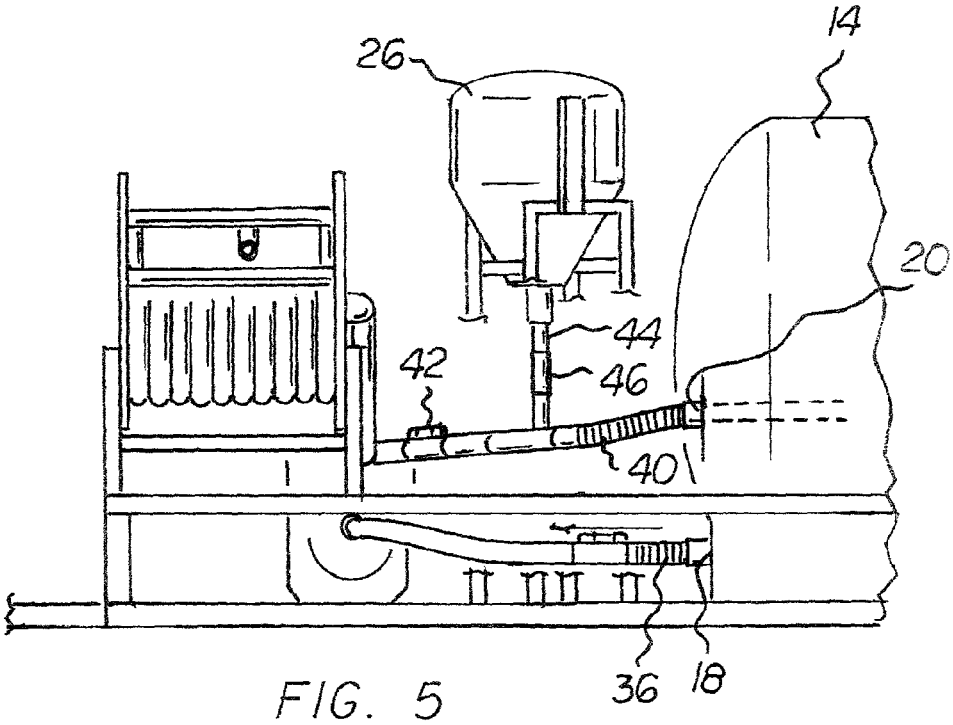
FIG. 5

FIRE-SUPPRESSION TECHNOLOGY SYSTEM

RELATED APPLICATION

This application claims the benefit of Provisional Application No. 62/032,287 filed Aug. 1, 2014 and Application No. 62/036,468 filed Aug. 12, 2014, the subject matter of which is incorporated herein by reference.

BACKGROUND OF THE INVENTION

Field of the Invention

The present invention relates to a fire-suppression technology system and more particularly pertains to creating a fire-suppressing fluid and for dispensing the created fire-suppressing fluid, the creating and the dispensing being done in a safe, convenient, and economical manner.

Description of the Prior Art

The use of fire-suppression systems and methods of known designs and configurations are known in the prior art. More specifically, fire-suppression systems and methods of known designs and configurations previously devised and utilized for the purpose of suppressing fires are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned patents do not describe fire-suppression technology systems that allows creating a fire-suppressing fluid and for dispensing the created fire-suppressing fluid onto a region to be controlled, the creating and the dispensing being done in a safe, convenient, and economical manner.

In this respect, the fire-suppression technology systems according to the present invention substantially departs from the conventional concepts and designs of the prior art, and in doing so provides an apparatus primarily developed for the purpose of fire-suppression technology systems.

Therefore, it can be appreciated that there exists a continuing need for a new and improved fire-suppression technology systems which can be used for fire-suppression technology systems. In this regard, the present invention substantially fulfills this need.

SUMMARY OF THE INVENTION

In view of the disadvantages inherent in the known types of fire-suppressing fluids and systems of known designs and configurations now present in the prior art, the present invention provides an improved fire-suppression technology system. As such, the general purpose of the present invention, which will be described subsequently in greater detail, is to provide a new and improved fire-suppressing system and method which has all the advantages of the prior art and none of the disadvantages.

From a broad perspective, the present invention is a fire-suppressing technology system having a tank with outlet and inlet orifices. A reservoir has a dispensing orifice. The tank receives water. The reservoir receives a quantity of powder adapted to be converted to a fire-suppressing fluid when mixed with water. A pump operatively couples the tank and the reservoir. A hose is operatively coupled to the pump. A spool is supports the hose. A primary path of travel constitutes a closed loop path between the tank and the pump and the reservoir to create a fire-suppressing fluid. A secondary path of travel constitutes an open path for dispensing the fire-suppressing fluid from the tank and the pump toward a region to be controlled.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved fire-suppression technology systems which has all of the advantages of the prior art fire-suppression systems and methods of known designs and configurations and none of the disadvantages.

It is another object of the present invention to provide a new and improved fire-suppression technology systems which may be easily and efficiently manufactured and marketed.

It is further object of the present invention to provide a new and improved fire-suppression technology systems which is of durable and reliable constructions.

An even further object of the present invention is to provide a new and improved fire-suppression technology systems which is susceptible of a low cost of manufacture with regard to both materials and labor, and which accordingly is then susceptible of low prices of sale to the consuming public, thereby making such fire-suppression technology systems economically available to the buying public.

Lastly, it is an object of the present invention to provide a new and improved fire-suppression technology system and method for creating a fire-suppressing fluid and for dispensing the created fire-suppressing fluid onto a region to be controlled, the creating and the dispensing being done in a safe, These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a rear elevational view of the system taken along line 2-2 of FIG. 1.

FIG. 3 is a front elevational view of the system taken along line 3-3 of FIG. 1.

FIGS. 4 and 5 are cross sectional views taken along lines 4-4 and 5-5 of FIG. 3.

The same reference numerals refer to the same parts throughout the various Figures.

DESCRIPTION OF THE PREFERRED EMBODIMENT

Figure 1:
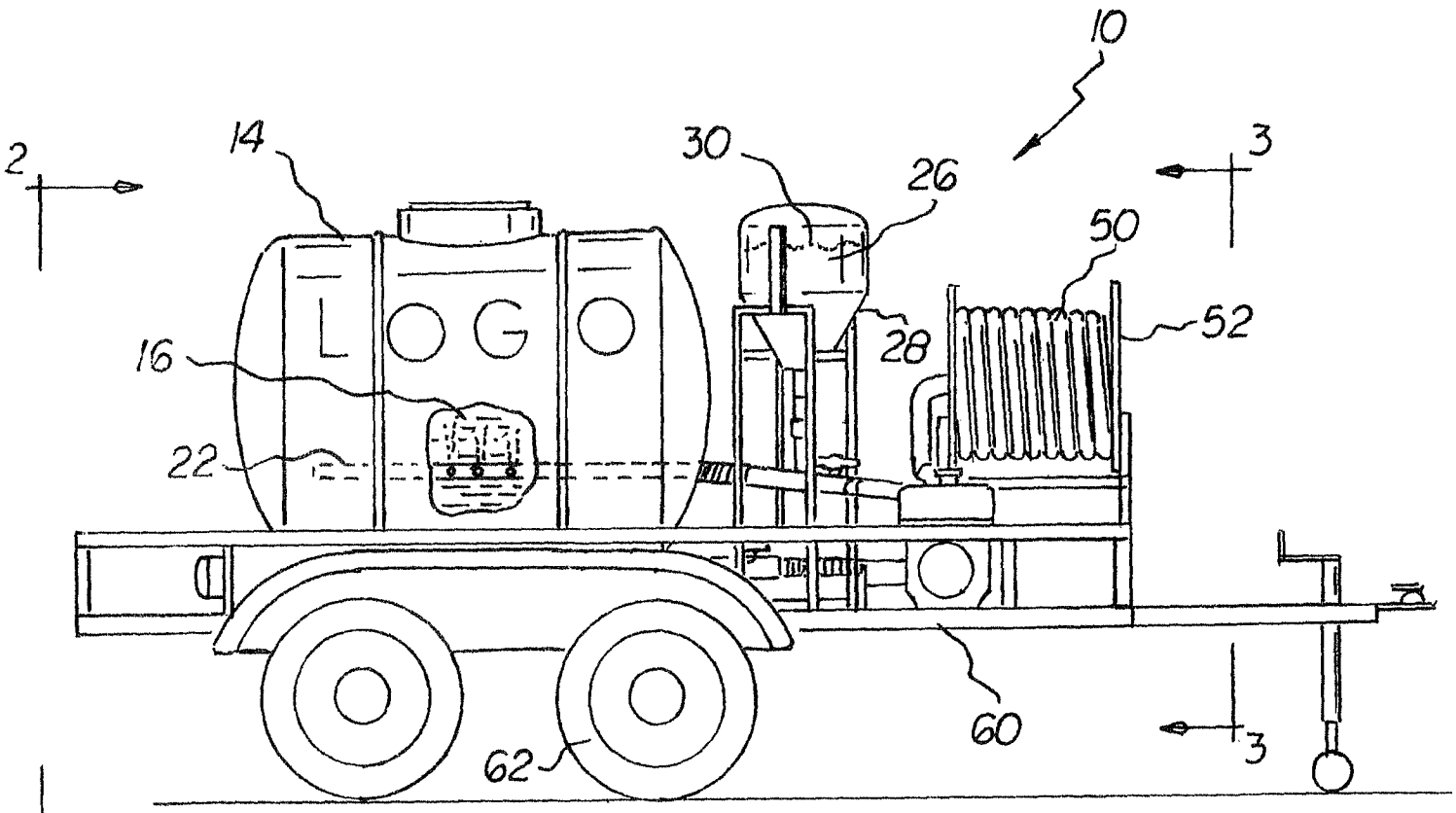
FIG. 1 is a side elevational view of a fire-fighting system constructed in accordance with the principles of the present invention.

With reference now to the drawings, and in particular to FIG. 1 thereof, the preferred embodiment of the new and improved fire-fighting system embodying the principles and concepts of the present invention and generally designated by the reference numeral 10 will be described.

The present invention, the fire-suppression technology system 10 is comprised of a plurality of components. Such components are individually configured and correlated with respect to each other so as to attain the desired objective. In their broadest context such include a tank, a reservoir, a pump, a hose, a primary path, and a secondary path.

From a specific perspective, in the preferred embodiment of the present invention first provided is a tank 14. The tank is in a generally cylindrical configuration. The tank has a horizontal axis. A quantity of water 16 is provided. The tank houses the quantity of water. The tank has an outlet orifice 18. The outlet orifice is adjacent to the lowermost extent of the tank. The tank has an inlet orifice 20. The inlet orifice is adjacent to the lowermost extent of the tank. A manifold 22 is provided. The manifold is positioned in the tank. The manifold has a first end. The first end is coupled to the inlet orifice. The manifold has a linear extent. The manifold has spaced apertures. The space apertures are beneath, laterally offset from, and parallel with the horizontal axis of the tank.

A reservoir 26 is provided. The reservoir has a frusto-conical side wall 28. The frusto-conical side wall has a vertical axis. The frusto-conical side wall terminates below in a dispensing orifice. The reservoir housing has a quantity of powder 30. The powder is adapted to be converted to a fire-suppressing fluid when mixed with water. The dispensing orifice is at an elevation above the manifold.

Provided next is a pump 34. The pump operatively couples the tank and the reservoir. A first line 36 is provided. A first shut-off valve 38 is provided. The first line couples the outlet orifice of the tank and the first shut-off valve 38. A second line 40 is provided. A second shut-off valve 42 is provided. The second line couples the manifold and the pump with the second shut-off 42. A third line 44 is provided. A third shut-off valve 46 is provided. The third line couples the reservoir and the second line with the third shut-off valve.

The third valve is an eductor valve with an eductor in the second line adjacent to the eductor valve. This is the location where the powder from the reservoir first mixes with the water of the second line to create the fire-suppressing fluid. The eductor maximizes agitation between the powder and the water for providing maximum fire-suppressing power.

A hose 50 is provided. A spool 52 is provided. The spool supports the hose. A fourth line 54 is provided. A fourth shut-off valve 56 is provided. The fourth line couples the second line and the hose with the fourth shut-off valve 56. The hose is adapted to dispense fire-suppressing fluid.

Also provided is a primary path of travel. The primary path of travel is formed by the first line and the second line and the third line. The first shut-off valve and the second shut-off valve and the third shut-off valve are open. The fourth shut-off valve is closed. The primary path of travel constitutes a closed loop path. In this manner the fire-suppressing fluid is created.

Further provided is a secondary path of travel. The secondary path of travel is formed by the first line and the fourth line. The first shut-off valve and the fourth shut-off valve are open. The second shut-off valve and third shut-off valve are closed. The secondary path of travel constitutes an open path. In this manner the fire-suppressing fluid is dispensed toward a region to be controlled. Although the shut-off valves are illustrated as being hand controlled, it should be appreciated that the shut-off valves are also adapted to be controlled by computer controls.

Provided last is a pallet 60. The pallet supports the tank and the reservoir and the pump and the hose. The pallet has wheels 62. In this manner the pallet may be transported. It should be appreciated that the pallet may also be adapted to be handled and transported without wheels. As to the manner of usage and operation of the present invention, the same should be apparent from the above description. Accordingly, no further discussion relating to the manner of usage and operation will be provided.

The system of the present invention disseminates environmentally friendly materials both as a preventable measure and as a fire reduction/suppression capability. In other words, the present invention can be used to dispense fire damage reduction compounds in both a protective and reactive manner. It is intended for both residential and commercial use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fire-suppression technology system (10) for creating a fire-suppression fluid and for dispensing the created fire-suppressing fluid onto a region to be controlled, the system comprising, in combination:

a tank (14) having a generally cylindrical configuration with a horizontal axis, the tank housing a quantity of water (16), the tank having an outlet orifice (18) adjacent to a lowermost extent of the tank, the tank having an inlet orifice (20) adjacent to the lowermost extent of the tank, a manifold (22) positioned in the tank, the manifold having a first end coupled to the inlet orifice, the manifold having a linear extent with spaced apertures beneath, and laterally offset from, and parallel with the horizontal axis of the tank;

a reservoir (26) having a frusto-conical side wall (28) with a vertical axis terminating below in a dispensing orifice, the reservoir housing a quantity of powder (30), the powder adapted to be converted to a fire-suppression fluid when mixed with water, the dispensing orifice being at an elevation above the manifold;

a pump (34) operatively coupling the tank and the reservoir, a first line (36) coupling the outlet orifice of the tank and the pump with a first shut-off valve (38), a second line (40) coupling the manifold and the pump with a second shut-off valve (42), a third line (44) coupling the reservoir and the second line with a third shut-off valve (46);

a hose (50), a spool (52) supporting the hose, a fourth line (54) coupling the second line and the hose with a fourth shut-off valve (56), the hose adapted to dispense fire-suppressing fluid;

a primary path of travel formed by the first line and the second line and the third line while the first shut-off valve and the second shut-off valve and the third, shut-off valve are open and while the fourth shut-off valve is closed, the primary path of travel constituting a closed loop path for creating the fire-suppressing fluid;

a secondary path of travel formed by the first line and the fourth line while the first shut-off valve and the fourth shut-off valve are open and while the second shut-off valve and third shut-off valve are closed, the secondary path of travel constituting an open path for dispensing the fire-suppressing fluid toward a region to be controlled; and a pallet (60) supporting the tank and the reservoir and the pump and the hose, the pallet having wheels (62) for transportation purposes.

2. The system as set forth in claim 1 wherein the third valve is an eductor valve with an eductor in the second line adjacent to the eductor valve.

3. The system as set forth in claim 1 wherein the shut-off valves are adapted to be controlled by computer controls.

* * * * *